US008266872B2

(12) United States Patent
Ehrsam et al.

(10) Patent No.: US 8,266,872 B2
(45) Date of Patent: Sep. 18, 2012

(54) PACKAGING TUBE FOR A PREDETERMINED VOLUME OF A BIOLOGICAL SUBSTANCE TO BE STORED AT A LOW TEMPERATURE AND SYSTEM INCLUDING SAME

(75) Inventors: Alain Ehrsam, Lyons (FR); Laurence Marie Evelyne Ehrsam, legal representative, Lyons (FR); Philippe Jean Paul Ehrsam, legal representative, Rochetaille sur Saone (FR); Laurent Christophe Ehrsam, legal representative, Crémieu (FR); Francis Lesieur, Saint-Michel Thuboeuf (FR)

(73) Assignee: Cryo Bio System, L'Aigle (FR)

( * ) Notice: Subject to any disclaimer, the term of this patent is extended or adjusted under 35 U.S.C. 154(b) by 69 days.

(21) Appl. No.: 12/527,737

(22) PCT Filed: Feb. 8, 2008

(86) PCT No.: PCT/FR2008/000158

§ 371 (c)(1),
(2), (4) Date: Aug. 19, 2009

(87) PCT Pub. No.: WO2008/116977

PCT Pub. Date: Oct. 2, 2008

(65) Prior Publication Data

US 2010/0107560 A1 May 6, 2010

(30) Foreign Application Priority Data

Feb. 19, 2007 (FR) ..... 07 53346

(51) Int. Cl.
*B65B 7/14* (2006.01)

(52) U.S. Cl. ..... 53/375.9; 53/477; 220/600

(58) Field of Classification Search ..... 53/467, 53/469, 477, 411, 284.5, 284.7, 375.8, 375.9; 215/46, 47; 220/600, 602, 604
See application file for complete search history.

(56) References Cited

U.S. PATENT DOCUMENTS

| | | | | |
|---|---|---|---|---|
| 829,178 | A * | 8/1906 | Stegmaier | 215/47 |
| 3,862,684 | A * | 1/1975 | Schmitt | 206/277 |
| 3,993,223 | A * | 11/1976 | Welker et al. | 222/107 |
| 4,415,393 | A * | 11/1983 | Grimes | 156/244.13 |
| 4,502,616 | A * | 3/1985 | Meierhoefer | 222/215 |
| 5,047,271 | A * | 9/1991 | Feddersen et al. | 428/36.92 |

(Continued)

FOREIGN PATENT DOCUMENTS

CN 2838744 Y 11/2006

(Continued)

*Primary Examiner* — Paul R Durand
(74) *Attorney, Agent, or Firm* — Browdy and Neimark, PLLC

(57) ABSTRACT

The invention relates to a packaging tube for a pre-determined volume of a biological substance to be stored at a low temperature and to a system including same. The inventive packaging tube comprises a portion (2) for receiving the volume and an annular end portion (3) designed to be more easily crushed by pinching than the receiving portion (2) and to adopt a flattened position in which two lips (30) are in contact with one another. In addition, the annular end portion (3) is designed such that the lips (30) are secured to one another in order to form a seal (31) on the tube. The system includes at least one such tube and a jaw welding device designed to move the annular portion (3) into the flattened position and to weld the lips (30) to one another in order to form the seal (31).

12 Claims, 6 Drawing Sheets

U.S. PATENT DOCUMENTS

| | | | | |
|---|---|---|---|---|
| 5,158,192 | A * | 10/1992 | Lataix | 215/48 |
| 5,203,379 | A * | 4/1993 | Holoubek et al. | 138/109 |
| 5,722,830 | A * | 3/1998 | Brandhorst et al. | 433/90 |
| 6,254,376 | B1 * | 7/2001 | Louviere | 425/547 |
| 6,673,301 | B2 * | 1/2004 | Cargile et al. | 264/509 |
| 6,918,418 | B1 * | 7/2005 | Farris | 141/319 |
| 7,487,894 | B2 * | 2/2009 | Zahn et al. | 222/541.9 |
| 7,950,540 | B2 | 5/2011 | Bara | |

FOREIGN PATENT DOCUMENTS

| | | | |
|---|---|---|---|
| EP | 0635305 | A | 1/1995 |
| FR | 2465190 | A1 | 3/1981 |
| GB | 722969 | A | 2/1955 |
| WO | 0168166 | A | 9/2001 |
| WO | 03022435 | A | 3/2003 |

* cited by examiner

PACKAGING TUBE FOR A PREDETERMINED VOLUME OF A BIOLOGICAL SUBSTANCE TO BE STORED AT A LOW TEMPERATURE AND SYSTEM INCLUDING SAME

The present invention concerns the packaging of biological substances to be stored at a low temperature.

Already known in the art are tubes for packaging biological substances to be stored at deep-freeze temperatures (between −20° C. and −40° C.) or at cryogenic temperatures (between −180° C. and −196° C.), such as capillary tubes, for example, also known as "straws" and intended to receive small volumes of biological substances.

Straws, initially open at both ends, are sealed at these ends by heat welding after filling.

Also known in the art, for use when straws cannot be used, for example for greater volumes of biological substances or for tissue samples with dimensions greater than the inside diameter of a straw, are tubes with an inside diameter at least equal to 6 mm, in relatively rigid plastic material (such as polycarbonate or polypropylene), closed at one end and open at the opposite end, and having a portion for receiving the biological substance and an end portion adapted to cooperate with a stopper.

One such tube is known in particular from French patent 2 865 190, which describes such a tube provided with a threaded portion and the stopper of which is of the threaded type.

The invention aims to improve the performance of such a tube, notably with regard to protection against contamination.

To this end it proposes a tube for packaging a predetermined volume of biological substance to be stored at a low temperature, of inside diameter at least equal to 6 mm, closed at one end and having an opening at the opposite end for introducing into it said pre-determined volume, said tube including a portion for receiving said volume, characterized in that said tube also includes an annular end portion adapted to be crushed by clamping more easily than said receiving portion and to assume a flattened position in which two lips are in contact with each other, said annular end portion being such that said lips are fastened together to form a hermetic seal of said tube.

The presence of an annular end portion that is more easily deformable and provided for sealing this portion by crushing, for example by welding, produces under good conditions a perfectly hermetic closure of the tube whilst preserving satisfactory mechanical strength in the reception portion of this tube.

The perfectly hermetic closure obtained with the tube of the invention thus offers total safety, notably in the case of storage at cryogenic temperatures.

In this regard it will be noted that the stoppers known in the prior art are liable to produce a defective seal (a potential source of contamination) given the high stresses to which they are subjected by virtue of the pressure difference between the interior and the exterior of the tube that is generated on cooling.

It will be noted that the packaging tube of the invention is thus conformed to produce an effective hermetic seal even though its dimensions are greater than those of straws.

According to features that are preferred for reasons of simplicity of use and of convenient and economic implementation:

said annular portion has over at least a part of its length a thickness less than the thickness of said receiving portion;

the thickness of said annular portion decreases regularly in the direction that goes from said receiving portion to said opening for introduction of said volume; and/or an annular groove is produced in said annular portion.

According to features that are preferred for the same reasons as stated above:

said seal is a heat weld; or said seal is produced by a UV-activated glue.

Sealing by welding, by permanent gluing or by any other means necessitating cutting to access the content of the tube thus provides a simple way to guarantee that the content of the tube is inviolable.

According to other preferred features:

said tube also includes at least one localized sampling area that is easier to perforate than its surroundings;

said receiving portion has on the side opposite said annular end portion a housing for receiving an identification element for identifying said substance;

said housing is occupied by a resin adapted to retain said identification element;

said receiving portion includes a sleeve for identifying said biological substance;

said sleeve has at least one window for viewing the interior of said tube; and/or said tube is produced from plastic materials by two-material injection molding.

A second aspect of the invention consists in a system for packaging a pre-determined volume of biological substance to be stored at a low temperature, characterized in that it includes at least one tube as described hereinabove and a welding device with jaws adapted to cause said annular portion to assume said flattened position and to weld said lips together to form said hermetic seal.

The description of the invention continues now with a detailed description of one embodiment, given hereinafter by way of nonlimiting illustration and with reference to the appended drawings. In the latter:

Figure 1:
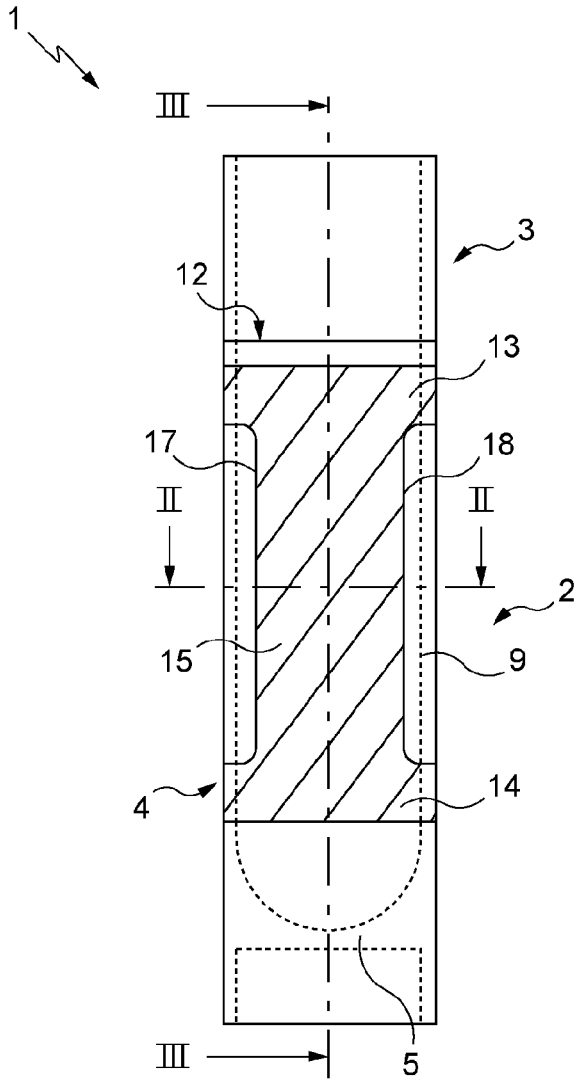
FIG. 1 is a view in elevation of a packaging tube of the invention.
Figure 3:
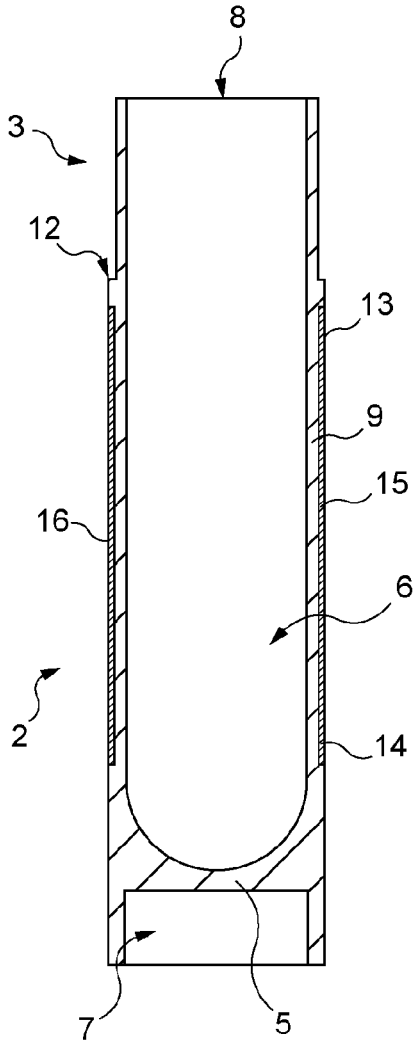
FIG. 3 is a view in elevation of this tube in section taken along the line III-III in FIG. 1.
Figure 2:
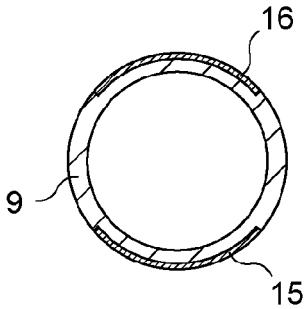
FIG. 2 is a plan view of this tube in section taken along the line II-II in FIG. 1.

The packaging tube 1 shown in FIGS. 1 to 3 includes a portion 2 for receiving a biological substance and an annular end portion 3.

Such a tube is intended to receive samples of high volume or of relatively large size such as tissue samples, for example.

The receiving portion 2 has a tubular portion 9 and a sleeve 4 partially covering the tubular portion 9.

The portions 3 and 9 are in Surlyn® low-density polyethylene and the sleeve 4 in Santoprene® SEBS.

The portions 3 and 9 with the sleeve 4 are produced from plastic materials by two-material injection molding.

The tube 1 has an opening 8 at the edge of the annular portion 3 but is blocked in the vicinity of the opposite end by a transverse end wall 5.

This wall 5 is slightly recessed relative to the end opposite the opening 8, so that this recessed wall delimits with the rest of the receiving portion 2, on the same side as the portion 3, a housing 6 for receiving the biological substance and, on the other side, a housing 7 that is adapted to receive an element for identifying the biological substance (see below).

The annular end portion 3 is a tubular portion thinner than the receiving portion 2 so that the tube has at the junction of the portions 2 and 3 a shouldered surface 12.

The sleeve 4 is embedded in the portion 9 so that the receiving portion 2 (the sleeve 4 and the portion 9) has a constant thickness (in the areas of the portion 9 covered or not covered by the sleeve 4) greater than that of the annular portion 3.

This sleeve has two rings 13 and 14 joined together by two strips 15 and 16 and so this sleeve has two windows 17 and 18 for viewing the content of the tube 1.

In the example shown, the tube 1 has a height of 48 mm and an inside diameter of 9.8 mm.

The sleeve 4 has a thickness of 0.3 mm.

The receiving portion 2 has a wall 1.0 mm thick (1 mm of Surlyn® in the portion 9 in the areas not covered by the sleeve and 0.7 mm of Surlyn® in the portion 9 to which is added 0.3 mm of Santoprene® for the sleeve 4 in the areas of the portion 9 covered by the sleeve), whereas the annular end portion 3 has a wall 0.6 mm thick.

The dimensions of the tube 1 are chosen in accordance with market standards so that this tube is in particular adapted to be placed in standard boxes for storing threaded packaging tubes.

Two other standard values for the height of these tubes are 70 mm and 92 mm.

The housing 7 of the tube 1 is designed to receive an element 21 (shown only in FIGS. 4 and 5) for identifying the biological substance, such as an RFID chip or a one-dimensional or two-dimensional bar code (also known as a Datamatrix).

The identification element 21 is held in position in this housing by a transparent resin 22 poured into this housing to fix the position of this identification element.

It is equally possible to stick to this tube a label (not shown) carrying a flexible chip.

If the interior of the tube must be kept sterile before filling, it is delivered in a box of tubes sterilized by radiation or in an individual sachet that can be peeled open.

Figure 10:
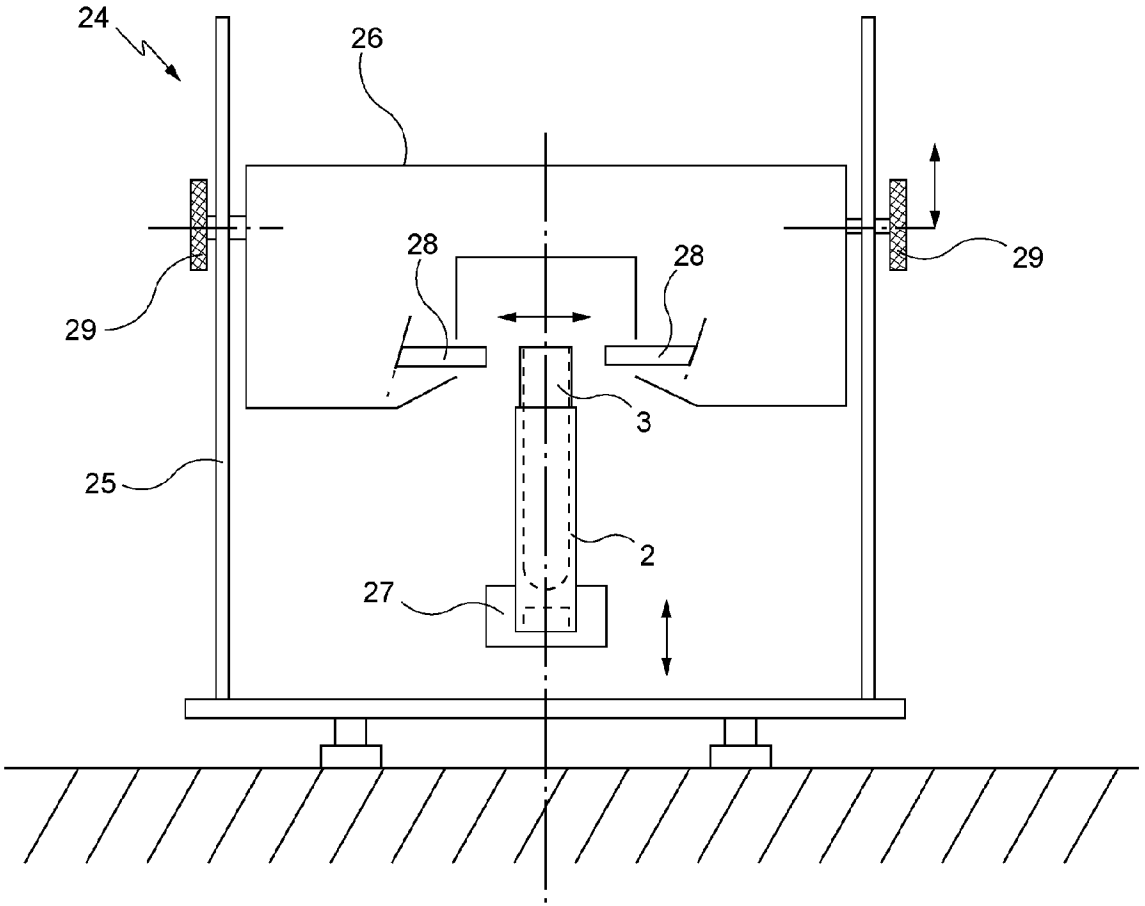
FIG. 10 is a view in elevation of a welding device in which is disposed a tray provided with a row of tubes of the invention.
Figure 11:
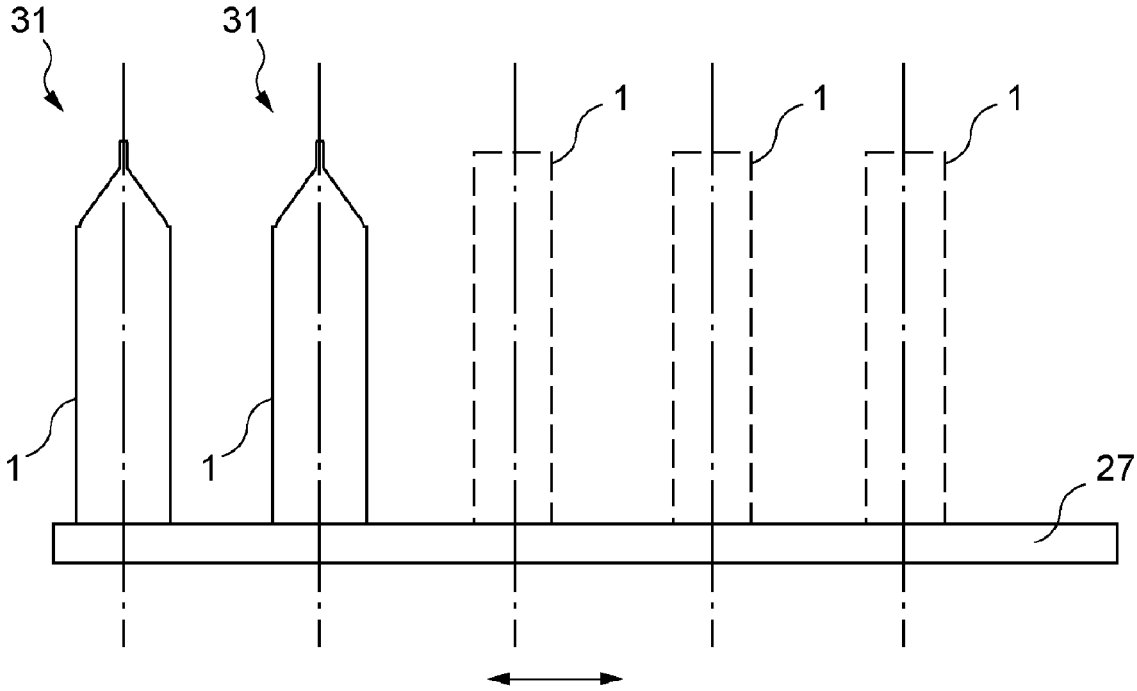
FIG. 11 is a view in elevation of that row of tubes and that tray after two tubes on the tray have been welded.

The packaging tube 1 is associated with a welding machine 24 shown in FIGS. 10 and 11.

This machine includes a frame 25, a mobile welding module 26 and a mobile tray 27.

The module 26 includes two mobile jaws 28 adapted to effect to-and-fro movements coordinated with the transverse displacement of the tray 27 carrying the filled tubes 1 so as to crush by clamping the annular portion 3 of each of the tubes 1.

The module 26 is adjustable along the frame 25 by means of thumbscrews 29 as a function of the height of the tubes.

How a packaging tube is hermetically sealed is described next with reference to FIGS. 4, 5, 10 and 11.

The tubes, previously filled with biological substance (for example using a pipette), are disposed in a row on the tray 27 and this tray is placed in the welding machine 24 on a mechanism (not shown) adapted to move the tray in translation in the direction of alignment of the tubes.

The tray is then moved so that the first tube in the row is disposed between the heating jaws 28.

The welding machine 24 is then commanded to drive the heating jaws 28 toward each other in the direction of the portion 3 of the tube 1 to crush this annular portion 3 of the tube by clamping it so that the portion crushed in this way assumes a flattened position, forming two lips 30 placed in contact with each other.

Figure 4:
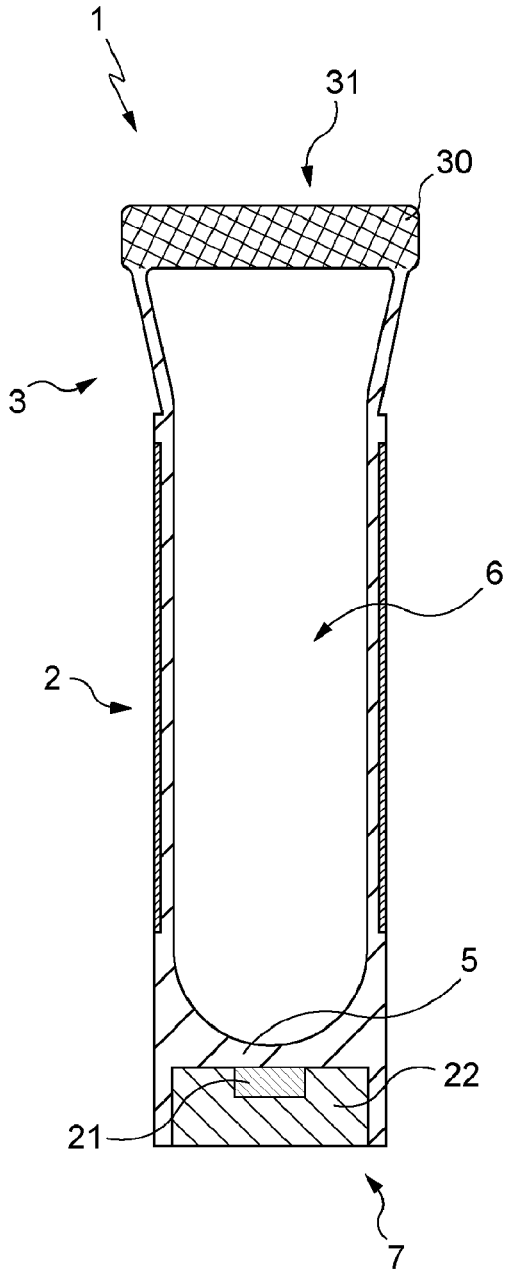
FIGS. 4 and 5 are two views similar to FIG. 3 but in two transverse planes and after an RFID chip has been fixed to the bottom of the tube and this tube has been hermetically sealed.
Figure 5:
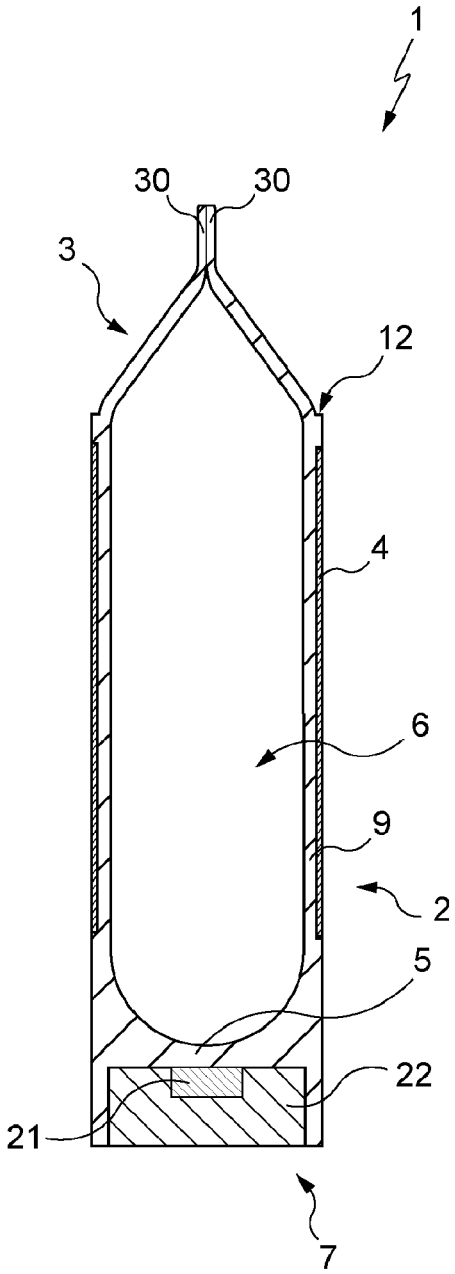

Simultaneously with the crushing, the heat transmitted to the Surlyn® of the portion 3 by the heating jaws leads to formation of a hermetic seal 31 between the two lips 30, as shown in FIGS. 4 and 5.

The crushing of the annular portion 3 leads to deformation of this portion under the welding area and possibly a slight deformation (not shown) of the receiving portion 2 (even though the wall of this portion is thicker and thus less easily deformable).

The crushing of the portion 3 leads to a slight reflow of material such that the weld 31 extends slightly beyond the original contour of the portion 3 (FIG. 4).

The wall of the portion 3 having a small thickness, this reflow is limited, this small thickness also ensuring fast and homogenous heating of the lips to be welded.

Such welding would be particularly difficult to produce on tubes that are not conformed like the tubes of the invention and with walls that are too thick in the welding area, because when they move toward each other such walls form at their ends beads that are relatively difficult to crush against each other, with the risk of compromising the quality of the weld, notably from the sealing point of view.

After the jaws 28 have returned to their original position, the machine 24 is then commanded to move the tray so that the next tube in turn is disposed between the jaws 28 (FIG. 11).

These operations continue in this way until the last tube in the row on the tray 27 has been welded.

These tubes can then be stored, for example in a conventional storage box. The welds 31 are offset relative to each other so that two adjacent tubes are not hampered by their respective welds.

To access the biological substance, the operator cuts the tube in an area of the annular portion 3 located under the weld 31, for example using a hot wire, a laser or some other accessory (sterile scissors, a scalpel or a tube-cutter, for example) in order to separate the portion of the tube with the weld 31 from the rest of the tube and thus obtain access to the biological substance.

Cutting the annular portion 3 is facilitated by the fact that it has a smaller thickness that renders it not only easier to deform and to weld than the rest of the tube but also easier to cut.

Figure 6:
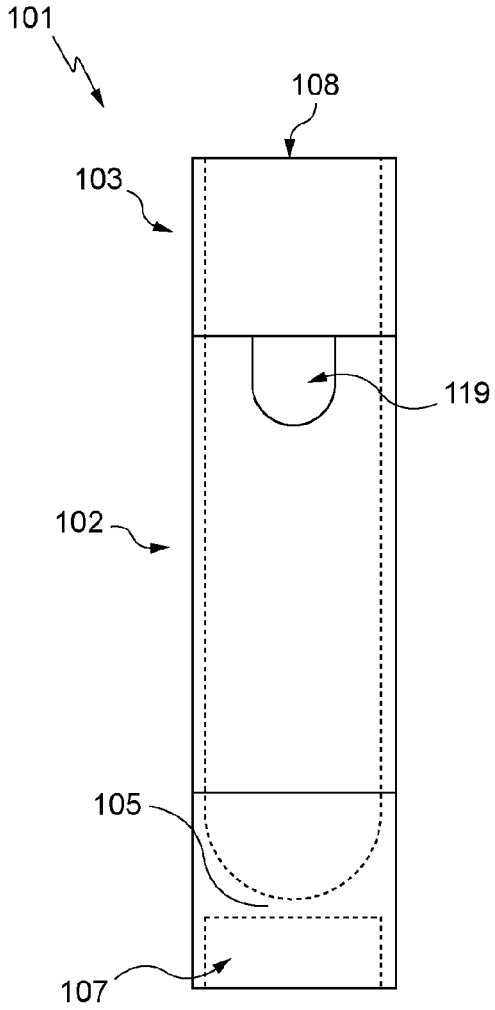
FIGS. 6 and 7 are two views similar to FIGS. 1 and 3 but are for a second embodiment of the tube.
Figure 7:
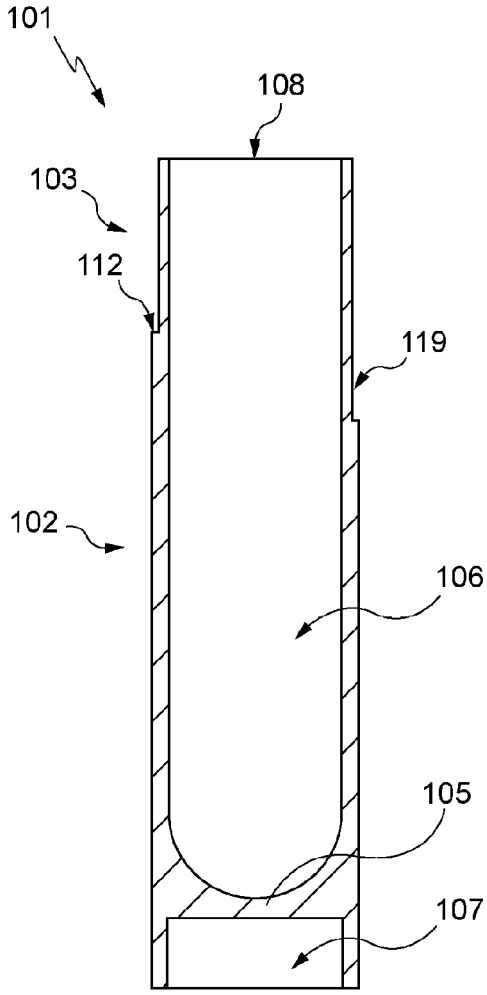

Another embodiment of the tube is shown in FIGS. 6 and 7.

As a general rule, the same references have been used for similar elements to which 100 has been added.

The tube 101 is similar to the tube 1 except that it has no sleeve 4 and has in the receiving portion 102, at the edge of the annular portion 103, a sampling area 119 of the same thickness as the annular portion 103, which is thus rendered easier to perforate than its immediate environment (here the portion 102).

This area therefore facilitates taking a sample of the liquid by inserting the tip of a syringe into the tube via this area.

It is then no longer necessary to cut the sealed portion of the tube to obtain access to the biological substance.

It will further be noted in this regard that, in the previous embodiment, it is equally possible to sample the liquid via the tip of a syringe by piercing the annular portion 3 that is not welded, although in the present embodiment this sampling area is clearly identified visually and is in the receiving portion 2.

In a variant of the tube 101 which is not shown, two or more sampling areas 119 are provided.

Figure 8:
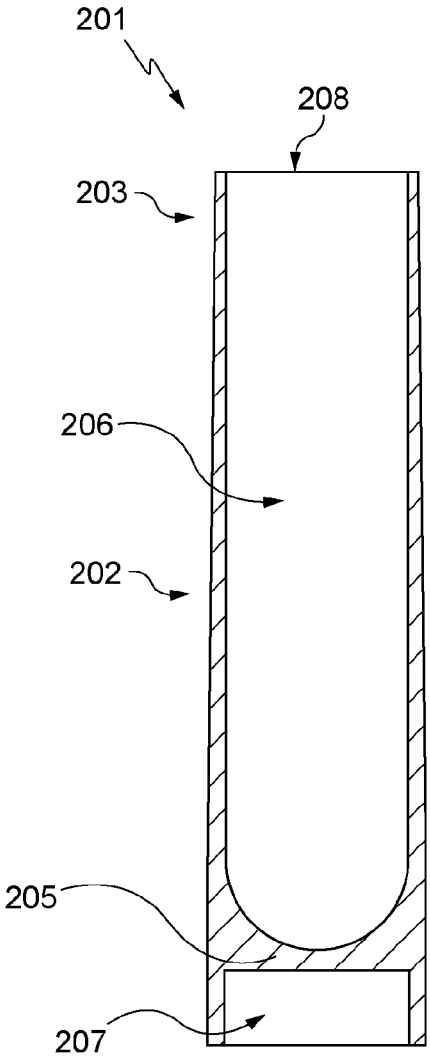
FIGS. 8 and 9 are two views similar to FIG. 3 and respectively showing third and fourth embodiments of the tube.

Another embodiment of the tube is shown in FIG. 8.

Generally speaking, the same references have been used for elements similar to those of the embodiment of FIGS. 1 to 5 to which, however, 200 has been added.

In this embodiment, the receiving portion 202 and the annular portion 203 are no longer separate, the shoulder 12 having disappeared, the thickness of the tube decreasing regularly in the direction that goes from the end wall 205 toward the opening 208.

The end portion 203 thus has a relatively small mean thickness so that this portion is rendered easier to deform, weld and cut than the rest of the tube.

Figure 9:
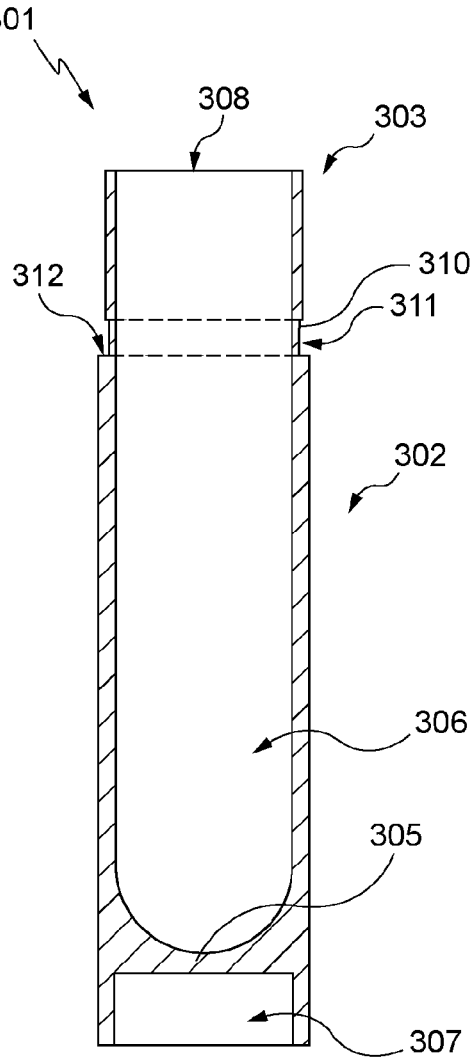

Another embodiment of the tube is shown in FIG. 9.

Generally speaking, the same references have been used for elements similar to those of the embodiment of FIGS. 1 to 5 to which, however, 300 has been added.

In this embodiment, the annular end portion 303 has at the junction with the receiving portion 302 a groove 310 intended to reduce the thickness of this portion locally, the surface 311 of the portion 303 situated at the bottom of this groove constituting a sampling area or a weakened area that is even easier to perforate and cut than the rest of the annular portion 303. In a variant that is not shown of the tubes 101 and 201, a groove of this kind is provided in the annular portion 103 or 203.

In a variant that is not shown of the tubes 101 and 301, the annular portion 103 or 303 has a thickness that decreases regularly in the direction that goes from the receiving portion 102 or 302 toward the introduction opening 108 or 308.

In a variant that is not shown of the tubes 101, 201 or 301, the weld formed in the annular end portion has a particular pattern adapted to identify which type of machine was used to produce this weld, to make the tube even more inviolable.

In another variant that is not shown the bottom of the receiving portion is conical in order to facilitate recovery of the liquid.

In a further variant the lips of the tube are sealed not by means of a heat weld but by activation of a glue (a UV-sensitive glue, for example).

Numerous other variants are possible as a function of circumstances and in this regard it is pointed out that the invention is not limited to the examples described and shown.

The invention claimed is:

1. Tube for packaging a predetermined volume of biological substance to be stored at a low temperature, of inside diameter at least equal to 6 mm, closed at one end and having an opening at the opposite end for introducing into the tube said pre-determined volume, said tube including a portion for receiving said volume, said portion comprising a wall having a predetermined thickness, wherein said tube also includes an annular end portion having a wall having at a least a part of its length which has a thickness thinner than the wall of the receiving portion, whereby said annular end portion is configured to be crushed by clamping more easily than said receiving portion and to assume a flattened position in which two lips at outer ends of the annular end portion are in contact with each other, said annular end portion being such that said lips are fastened together to form a hermetic seal of said tube.

2. Tube according to claim 1, wherein the thickness of the wall of said annular portion decreases regularly in the direction that goes from said receiving portion to said opening for introduction said volume.

3. Tube according to claim 1, further comprising an annular groove defined in said annular portion at a junction with said portion.

4. Tube according to claim 1, wherein said seal is a heat weld.

5. Tube according to claim 1, wherein said seal is produced by a UV-activated glue.

6. Tube according to claim 1, wherein said tube also includes at least one localized sampling area that is easier to perforate than its surroundings.

7. Tube according to claim 1, further comprising a housing defined in said receiving portion has on the side opposite said annular end portion for receiving an identification element for identifying said substance.

8. Tube according to claim 7, wherein said housing is occupied by a resin configured to retain said identification element.

9. Tube according to claim 1, wherein said receiving portion includes a sleeve for identifying said biological substance.

10. Tube according to claim 9, wherein said tube is produced from plastic materials by two-material injection molding.

11. Tube according to claim 1, wherein said sleeve has at least one window for viewing the interior of said tube.

12. System for packaging a pre-determined volume of biological substance to be stored at a low temperature, the system including at least one tube according to claim 1 and a welding device comprising jaws configured to cause said annular portion to assume said flattened position and to weld said lips together to form said hermetic seal.

* * * * *